United States Patent [19]

Green et al.

[11] Patent Number: 4,954,796

[45] **Date of Patent: * Sep. 4, 1990**

[54] MULTIPLE RESONATOR DIELECTRIC FILTER

[75] Inventors: Steven R. Green, Glendale Heights; David M. De Muro, Cary; Michael F. Moutrie, Buffalo Grove, all of Ill.; Raymond L. Sokola, Albuquerque, N. Mex.; Phillip J. Gordon, Carmel, Ind.

[73] Assignee: Motorola, Inc., Schaumburg, Ill.

[ * ] Notice: The portion of the term of this patent subsequent to Sep. 8, 2004 has been disclaimed.

[21] Appl. No.: 230,408

[22] Filed: Aug. 10, 1988

Related U.S. Application Data

[62] Division of Ser. No. 92,870, Sep. 3, 1987, Pat. No. 4,829,274, which is a division of Ser. No. 890,686, Jul. 25, 1986, Pat. No. 4,692,726.

[51] Int. Cl.[5] ..... H01P 1/205

[52] U.S. Cl. ..... 333/206; 333/202; 333/204; 333/222

[58] Field of Search ..... 333/202, 204, 1, 207, 333/219, 219.1, 222, 223, 245, 246; 455/73, 78, 1, 83; 370/30, 36, 38

[56] References Cited

U.S. PATENT DOCUMENTS

| | | | |
|---|---|---|---|
| 3,505,618 | 4/1970 | McKee | 333/203 |
| 3,728,731 | 4/1973 | Choi et al. | 333/202 |
| 3,970,880 | 7/1976 | Deutschmann et al. | 310/9.4 |
| 4,001,711 | 1/1977 | Knutson et al. | 330/66 |
| 4,255,729 | 3/1981 | Fukasawa et al. | 333/202 |
| 4,283,697 | 8/1981 | Masuda et al. | 333/202 |
| 4,292,562 | 9/1981 | Feder | 310/348 |
| 4,386,328 | 5/1983 | Masuda et al. | 333/202 |
| 4,425,555 | 1/1984 | Meguro et al. | 333/202 |
| 4,426,631 | 1/1984 | D'Avello et al. | 333/202 |
| 4,429,289 | 1/1984 | Higgins, Jr. et al. | 333/204 |
| 4,431,977 | 2/1984 | Sokola et al. | 303/202 X |
| 4,464,640 | 8/1984 | Nishikawa et al. | 333/202 |
| 4,523,162 | 6/1985 | Johnson | 333/202 |
| 4,533,188 | 8/1985 | Miniet | 339/17 CF |
| 4,546,333 | 10/1985 | Fukusawa et al. | 333/202 |
| 4,673,902 | 6/1987 | Takeda et al. | 333/202 X |
| 4,691,179 | 9/1987 | Blum et al. | 333/202 |
| 4,692,726 | 9/1987 | Green et al. | 333/202 X |
| 4,703,291 | 10/1987 | Nishikawa et al. | 333/202 |
| 4,716,391 | 12/1987 | Moutrie et al. | 333/202 X |
| 4,737,746 | 4/1988 | Ueno | 333/202 |
| 4,742,562 | 5/1988 | Kommrusch | 333/202 X |
| 4,799,033 | 1/1989 | Igarashi et al. | 333/202 X |

FOREIGN PATENT DOCUMENTS

| | | | |
|---|---|---|---|
| 0114503 | 7/1983 | Japan | 333/204 |
| 0191501 | 11/1983 | Japan . | |
| 0254802 | 12/1985 | Japan . | |

OTHER PUBLICATIONS

Uwano, "Ceramic-Filled Resonator Cuts Costs of Radio-telephone Filters", Electronics, Jul. 14, 1983, pp. 129-131.

*Primary Examiner*—Eugene R. LaRoche
*Assistant Examiner*—Seung Ham
*Attorney, Agent, or Firm*—Raymond A. Jenski; Rolland R. Hackbart

[57] ABSTRACT

A duplexer for a radio transceiver is disclosed in which two volumes of dielectric material each have at least two holes and each is covered with a conductive material except for one surface. An electrode on the one surface of each volume is coupled to one of the holes and is coupled to a substrate via a terminal passing through a mounting device. The substrate provides coupling between the terminals of the two volumes and a common antenna.

10 Claims, 6 Drawing Sheets

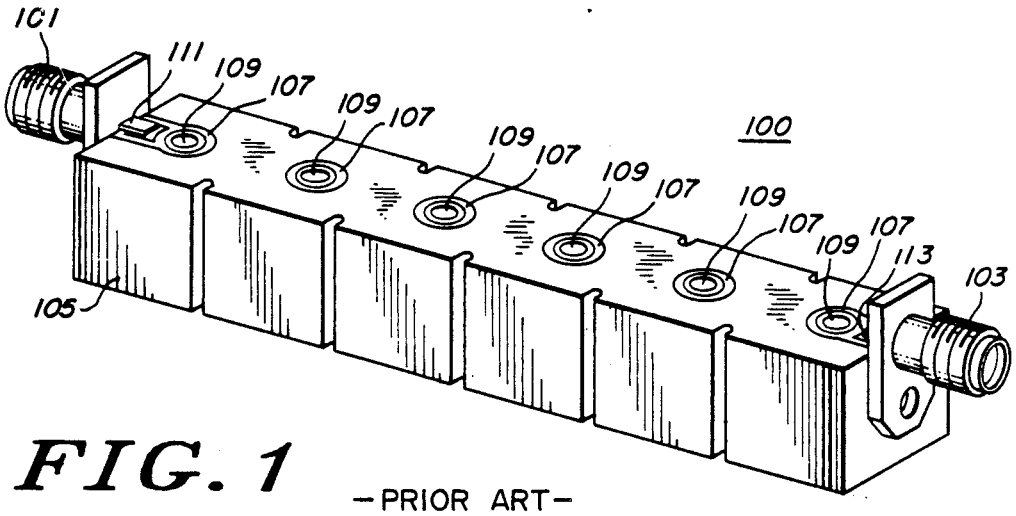
FIG. 1 —PRIOR ART—
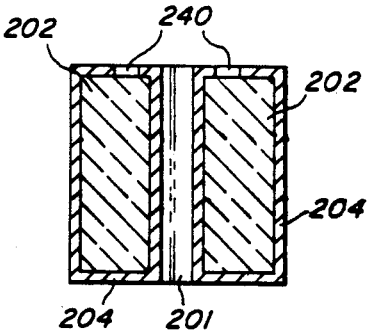
—PRIOR ART—
FIG. 2
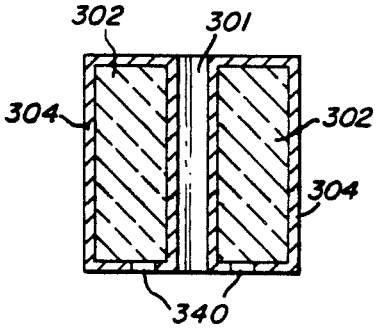
—PRIOR ART—
FIG. 3
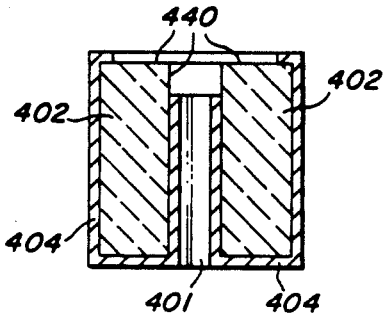
—PRIOR ART—
FIG. 4

MULTIPLE RESONATOR DIELECTRIC FILTER

This is a division of application Ser. No. 092,870, filed Sept. 3, 1987, now U.S. Pat. No. 4,829,274, which is a division of application Ser. No. 890,686, filed July 25, 1986, now U.S. Pat. No. 4,692,726.

BACKGROUND OF THE INVENTION

The present invention is related generally to radio frequency (RF) filters, and more particularly to a dielectric block band pass filter having improved capacitive inter-resonator coupling via metalization which produces a filter that is particularly well adapted for use in mobile and portable radio transmitting and receiving devices. This invention is related to the invention disclosed in U.S. Pat. No. 4,716,391.

Conventional dielectric filters offer advantages in physical and electrical performance which make them ideally suited for use in mobile and portable radio transceivers. Conventional multi-resonator filters include a plurality of resonators that are typically foreshortened short-circuited quarter-wavelength coaxial or helical transmission lines. The resonators are arranged in a conductive enclosure and may be inductively coupled one to another by apertures in their common walls. Other conventional filters may employ purely inductive coupling between resonators in a common dielectric block of material by preventing capacitive coupling between resonators. Capacitive coupling between dielectric block filter resonators has been employed in some types of filters (see U.S. patent application Ser. No. 656,121, "Single-Block Dual-Passband Ceramic Filter", filed in behalf of Kommrusch on Sept. 27, 1984). However, when a precise filter response is required, it has been found to be expensive to maintain the desired capacitive coupling for the filter response. Additionally, when a modification of filter parameters is needed, a complete redesign of the filter physical characteristics has traditionally been necessary.

SUMMARY OF THE INVENTION

Accordingly, it is an object of the present invention to provide a dielectric filter having an improved capacitive coupling.

It is another object of the present invention to enable a dielectric filter to have its filter characteristics modified by changing metalization coupling the resonators.

It is a further object of the present invention to couple improved dielectric filters in a configuration which enables their performance as a radio transceiver duplexer.

Therefore, as briefly described, the present invention encompasses a duplexer filter for a radio transceiver employing one antenna for both receiving and transmitting radio signals. Two volumes of dielectric material each having at least two holes extending from one external surface to another and substantially covered with a conductive material with the exception of one external surface upon which an electrode coupling to the conductive material of one of the holes is disposed. A conductive mounting means holding one of the volumes of dielectric material has a terminal extending through an internal surface and providing electrical contact to the electrode. A plurality of mounting tabs affix the mounting means to a substrate which couples one volume of dielectric material to another.

BRIEF DESCRIPTION OF THE DRAWINGS

FIG. 1 is a perspective view of a conventional dielectric filter illustrating the orientation of the resonator elements and the input/output coupling.

FIGS. 2, 3, and 4 are sectional view of FIG. 1 illustrating metalization patterns which may be employed in the resonator holes.

DETAILED DESCRIPTION OF THE PREFERRED EMBODIMENT

Figure 5:
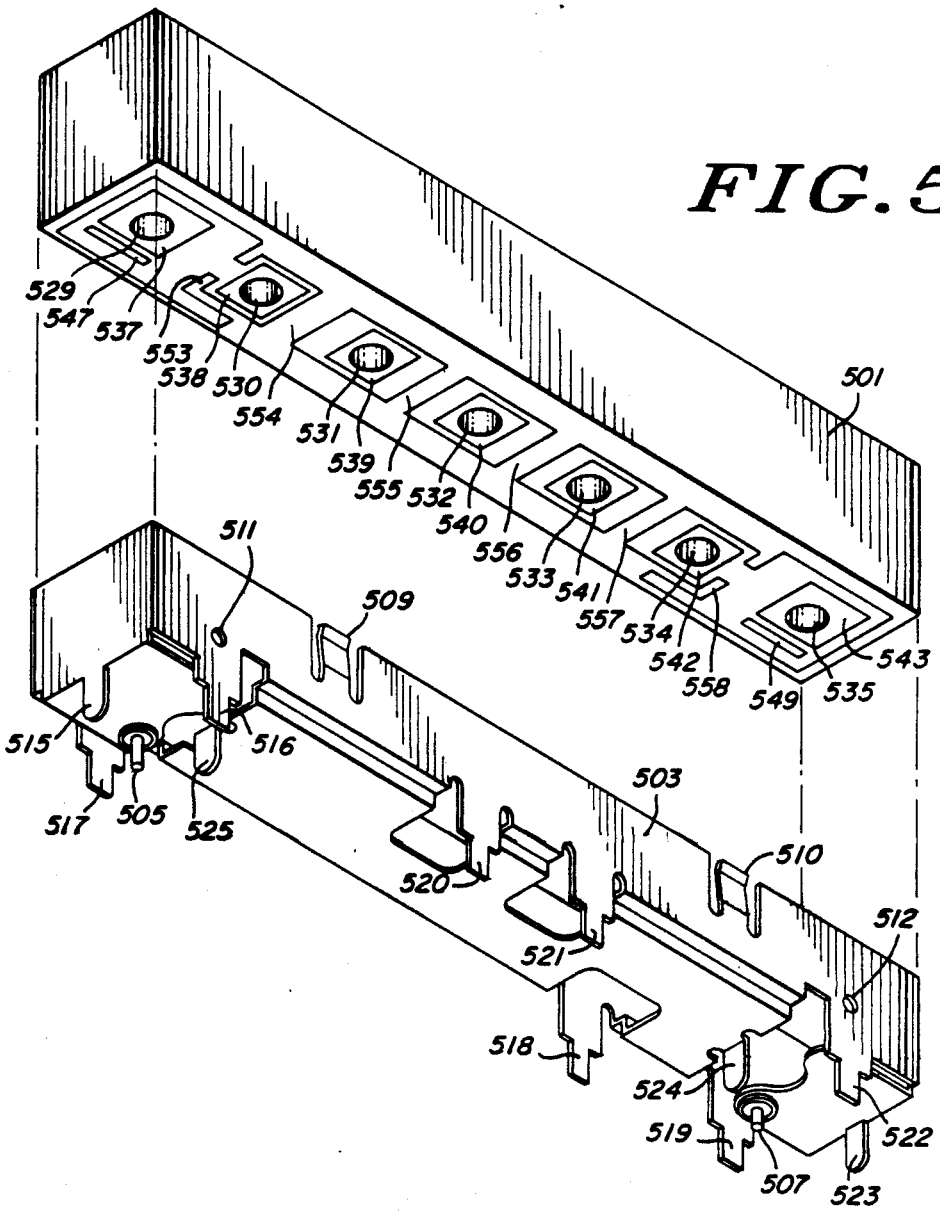
FIG. 5 is a bottom perspective of a dielectric block filter and mounting bracket employing the present invention.

In FIG. 1, there is illustrated a dielectrically loaded band pass filter 100 employing a conventional input connector 101 and a conventional output connector 103. Such a filter is more fully described in U.S. Pat. No. 4,431,977 "Ceramic Band Pass Filter" and assigned to the assignee of the present invention and incorporated by reference herein. Filter 100 includes a block 105 which is comprised of a dielectric material that is selectively plated with a conductive material Filter 100 is generally constructed of a suitable dielectric material such as a ceramic material which has low loss, a high dielectric constant, and a low temperature coefficient of the dielectric constant. In the preferred embodiment, filter 100 is comprised of a ceramic compound including barium oxide, titanium oxide and ziconium oxide, the electrical characteristics of which are similar to those described in more detail in an article by G. H. Jonker and W. Kwestroo, entitled "The Ternery Systems BaO-$TiO_2$-$ZrO_2$", Published in the Journal of the American Ceramic Society, Volume 41, no. 10 at pages 390–394, October, 1958. Of the ceramic compounds described in this article, the compound in table VI having the composition 18.5 mole percent BaO, 77.0 mole percent $TiO_2$ and 4.5 mole percent $ZrO_2$ and having a dielectric constant of approximately 40 is well suited for use in the ceramic of the present invention.

A dielectric filter such as that of block 105 Filter 100 is generally covered or plated, with the exception of areas 107, with an electrically conductive material such as copper or silver. A filter such as block 105 includes a multitude of holes 109 which each extend from the top surface to the bottom surface thereof and are likewise plated with an electrically conductive material. The plating of the holes 109 is electrically common with the conductive plating covering the block 105 at one end of the holes 109 and isolated from the plating covering the block 105 at the opposite end of the holes 109. Further, the plating of holes 109 at the isolated end may extend onto the top surface of block 105. Thus, each of the plated holes 109 is essentially a foreshortened coaxial resonator comprised of a short coaxial transmission line having a length selected for desired filter response characteristics. (Although the block 105 is shown in FIG. 1 with six plated holes, any number of plated holes may be utilized depending upon the filter response characteristics desired).

The plating of holes 109 in the filter block 105 is illustrated more clearly by the cross-section through any hole 109. Conductive plating 204 on dielectric material 202 extends through hole 201 to the top surface with the exception of a circular portion 240 around hole 201. Other conductive plating arrangements may also be utilized, two of which are illustrated in FIGS. 3 and 4. In FIG. 3, conductive plating 304 on dielectric material 302 extends through hole 301 to the bottom surface with the exception of portion 340. The plating arrangement in FIG. 3 is substantially identical to that in FIG. 2, the difference being that unplated portion 340 is on the bottom surface instead of on the top surface. In FIG. 4, conductive plating 404 on dielectric material 402 extends partially through hole 401 leaving part of hole 401 unplated. The plating arrangement in FIG. 4 can also be reversed as in FIG. 3 so that the unplated portion 440 is on the bottom surface.

Coupling between the plated hole resonators is accomplished through the dielectric material and may be varied by varying the width of the dielectric material and the distance between adjacent coaxial resonators. The width of the dielectric material between adjacent holes 109 can be adjusted in any suitable regular or irregular manner, such as, for example, by the use of slots, cylindrical holes, square or rectangular holes, or irregularly shaped holes.

As shown in FIG. 1, RF signals are capacitively coupled to and from the dielectric filter 100 by means of input and output electrodes 111 and 113, respectively, which, in turn, are coupled to input and output connectors 101 and 103, respectively.

The resonant frequency of the coaxial resonators provided by plated holes 109 is determined primarily by the depth of the hole, thickness of the dielectric block in the direction of the hole, and the amount of plating removed from the top of the filter near the hole. Tuning of filter 100 may be accomplished by the removal of additional ground plating or resonator plating extending upon the top surface of the block 105 near the top of each plated hole. The removal of plating for tuning the filter can easily be automated, and can be accomplished by means of a laser, sandblast trimmer, or other suitable trimming devices while monitoring the return loss angle of the filter.

Referring now to FIG. 5, a dielectric filter employing the present invention is shown in a exploded perspective view. A block of dielectric material 501 is placed in a carrying bracket 503 which performs the multiple functions of providing a rigid mounting platform such that dielectric block 501 may be inserted into a printed circuit board or other substrate, providing simplified input and output connections via feed through terminals 505 and 507, and providing positive ground contact between the conductive outer surface of dielectric block 501 and bracket 503 via contacts 509, 510, 511, 512, and other contacts not shown. Contacts 509 and 510 additionally provide a dielectric block 501 locating function within the bracket 503. Mounting bracket 503 further provides mounting tabs 515–525 to locate and support the bracket and filter on a mounting substrate and provide positive ground contact for radio frequency signals from the mounting bracket 503 to the receiving mounting substrate. A mounting bracket for a dielectric filter has been disclosed in U.S. patent application Ser. No. 656,121, "Single-Block Dual-Passband Ceramic Filter", filed in behalf of Kommrusch on Sept. 27, 1984 and assigned to the assignee of the present invention. This previously disclosed bracket, however, does not provide the simplified mounting of the bracket of the present invention.

In one preferred embodiment the dielectric filter 501 consists of a ceramic material and utilizes seven internally plated holes as foreshortened resonators to produce a band pass filter for operation in radio bands reserved for cellular mobile telephone. In this embodiment the conductive plating covering the ceramic block 501 extends conformally on all surfaces except that on which the resonator plating is wrapped from the holes onto the outer surface. Thus, holes 529–535 have corresponding plating 537–543 metallized on the outer surface of block 501 These areas 537–543 are electrically separate from the ground plating but provide capacitive coupling to the ground plating. Additionally, an input plated area 547 and an output plated area 549 provide capacitive coupling between the input terminal 505 and the coaxial resonator formed from the internally plated hole 529 and its externally plated area 537 while plated area 549 provides capacitive coupling between the output terminal 507 and the output resonator formed from plated hole 535 and external plated area 543. Ground stripes 553–558 are plated between the coaxial resonator plated holes in order that inter-resonator coupling is adjusted.

Figure 6:
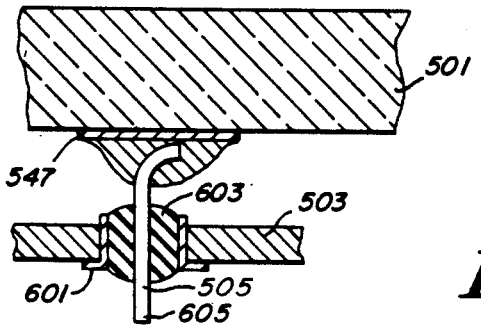
FIG. 6 is a sectional view illustrating an input or output terminal employed in the present invention.

Ceramic block 501 is inserted into bracket 503 with the externally plated resonator areas 537–543 oriented downward into the bracket 503 such that additional shielding is afforded by the bracket 503. Input mounting pin 505 is connected to plated area 547 and output terminal 507 is connected to plated area 549 as shown in FIG. 6. Input terminal 505, which may be a low shunt capacity feed through such as a 100B0047 terminal manufactured by Airpax Electronics Inc., consists of a solderable eyelet 601 and insulating glass bead 603 supporting a center conductor 605. The eyelet 601 is conductively bonded to bracket 503 to provide a secure mounting for the input connector 505. The center conductor 605 is brought into contact with plated area 547 by the dimensions of the bracket 503 and the block 501. The center conductor 605 is soldered or otherwise conductively bonded at one end to area 547 to provide a reliable RF connection to plated area 547. The other end of the center conductor 605 may then be easily soldered or plugged into a substrate which holds the mounting bracket 503. A similar construction is employed for output terminal 507 and its associated plated area 549.

Figure 7:
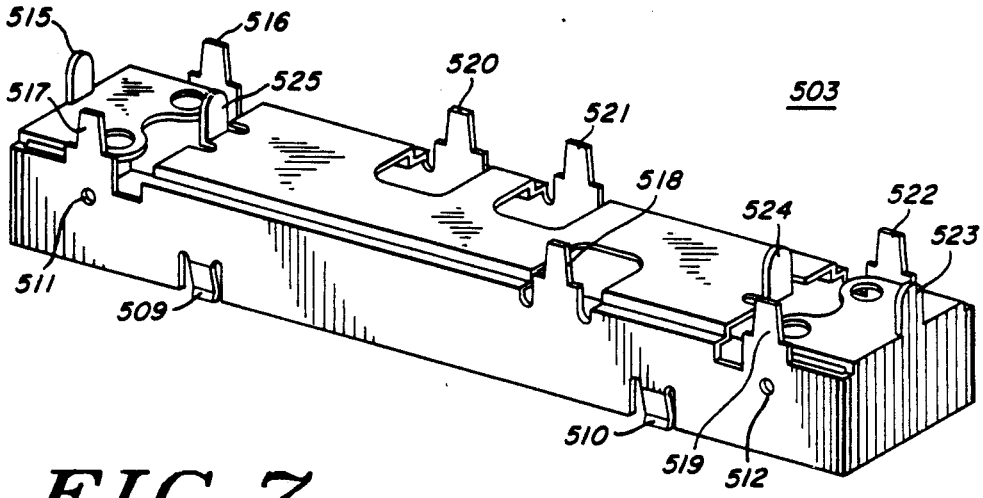
FIG. 7 is a dimensional diagram of the mounting bracket employed in the present invention.

A detail of the mounting bracket 503 is shown in FIG. 7. The spacing of the mounting tabs 515–525 is shown in detail for the preferred embodiment. These spacings are important at the frequencies of operation of this filter in order to maintain maximum ultimate attenuation. Low ground path inductance in the mounting bracket is realized by placing mounting tabs 517 and 519 close to the input and output ports (505 and 507 of FIG. 5 respectively) and the remainder of the tabs above the side and bottom of the bracket 503. Connection between the dielectric block 501 and bracket 503 is assured near the input and output terminals by contacts similar to contacts 511 and 512 located close to the terminals. All contacts, 509, 510, 511, and 512 (and the equivalent contacts on the opposite side of the brackets not shown), may be soldered or otherwise bonded to the dielectric block 501 such that electrical connection may be permanently assured.

It can be readily ascertained that the position of the tabs 518, 520, and 521 are asymmetrical. Also, the input-/output terminals 505 and 507 are offset from the centerline of the bracket 503. This asymmetry enables a "keying" of the bracket 503 so that a filter can be inserted in a printed circuit board or other substrate in only one orientation.

Figure 8:
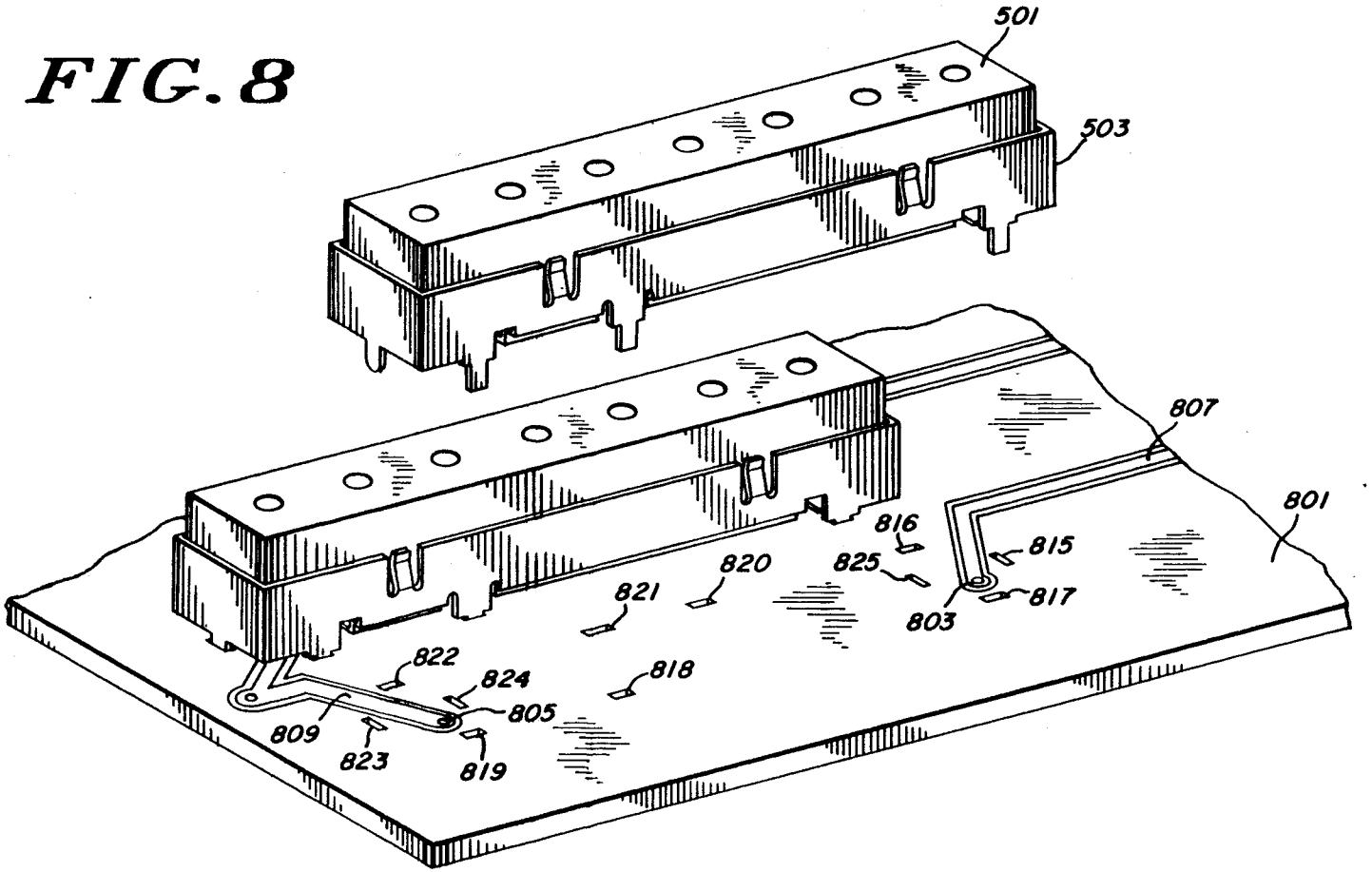
FIG. 8 is a dimensional view of a printed circuit board mounted duplexer employing component-mountable filters.

One unique aspect of the present invention is shown in FIG. 8. A dielectric filter block such as block 501 is mounted in bracket 503 and becomes a unitized circuit component which may be inserted into a printed circuit board or substrate 801. Appropriate holes 803 and 805 are located on the printed circuit board 801 to accept the input and output terminals 505 and 507 (not shown in FIG. 8), respectively. Further, appropriately located slots 815–825 are located in the printed circuit board 801 to accept the corresponding tabs of the bracket 503. Thus the filter 501 and bracket 503 may be mounted on a circuit board 801 like any other component and circuit runners may extend from the input hole 803 and the output hole 805 such that the filter may be electrically connected to other circuitry with a minimum of effort. The circuit board runners, 807 and 809, may be constructed as stripline or microstrip transmission lines to yield improved duplexer performance.

Figure 9:
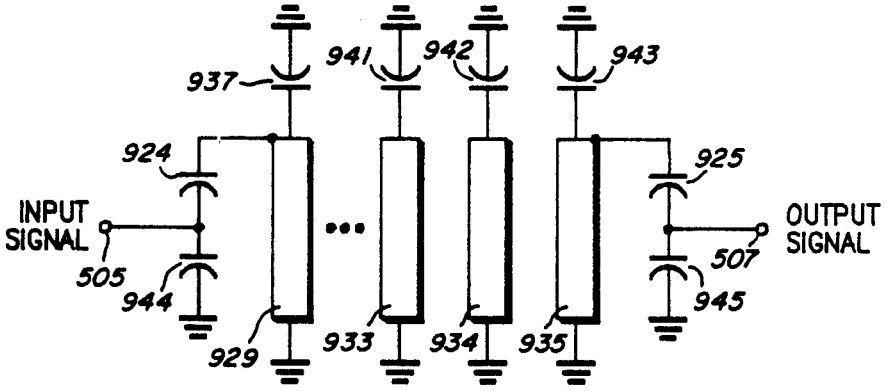
FIG. 9 is a schematic diagram of a component-mountable filter.

Referring to FIG. 9, there is illustrated an equivalent circuit diagram for the dielectric filter 501 utilized as a band pass filter. An input signal from a signal source may be applied via terminal 505 to input electrode 547 in FIG. 5, which corresponds to the common junction of capacitors 924 and 944 in FIG. 9. Capacitor 944 is the capacitance between electrode 547 and the surrounding ground plating, and capacitor 924 is the capacitance between electrode 547 and the coaxial resonator provided by plated hole 529 in FIG. 5. The coaxial resonators provided by plated 529–535 in FIG. 5 correspond to shorted transmission lines 929–935 in FIG. 9. Capacitors 937–943 in FIG. 9 represent the capacitance between the coaxial resonators provided by the extended plating 537–543 of the plated holes in FIG. 5 and the surrounding ground plating on the top surface. Capacitor 925 represents the capacitance between the resonator provided by plated hole 535 and electrode 549 in FIG. 5, and capacitor 945 represents the capacitance between electrode 549 and the surrounding ground plating. An output signal is provided at the junction of capacitors 925 and 945, and coupled to output terminal 547 for utilization by external circuitry.

Figure 10:
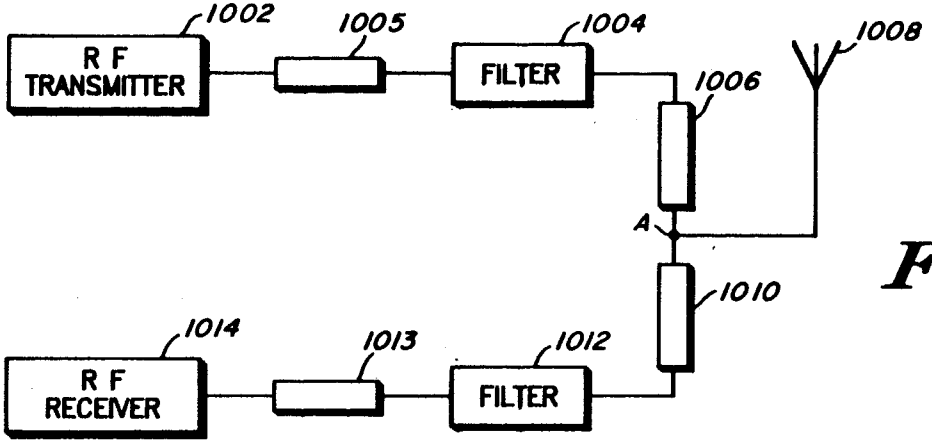
FIG. 10 is a schematic diagram of the duplexer of FIG. 8.

Referring now to FIG. 10, there is illustrated a multiband filter comprised of two intercoupled dielectric band pass filters 1004 and 1012 and employing the present invention. Two or more of the inventive band pass filters may be intercoupled on a printed circuit board or substrate to provide apparatus that combines and/or frequency sorts two RF signals into and/or from a composite RF signal. In one application of the preferred embodiment the present invention is employed in the arrangement of FIG. 10 which couples a transmit signal from an RF transmitter 1002 to an antenna 1008 and a receive signal from antenna 1008 to an RF receiver 1014. The arrangement in FIG. 10 can be advantageously utilized in mobile, portable, and fixed station radios as an antenna duplexer. The transmit signal from RF transmitter 1002 is coupled to filter 1004 by a transmission line 1005, realized by the plated runner 807 of FIG. 8 on the printed circuit board in the preferred embodiment, and the filtered transmit signal is coupled via circuit board runner transmission line 1006 (runner 809 of FIG. 8) to antenna 1008. Filter 1004 is a ceramic band pass filter of the present invention, such as the filter illustrated in FIGS. 5 and 8. The pass band of filter 1004 is centered about the frequency of the transmit signal from RF transmitter 1002, while at the same time greatly attenuating the frequency of the received signal. In addition, the length of transmission line 1006 is selected to maximize its impedance at the frequency of the received signal.

A received signal from antenna 1008 in FIG. 10 is coupled by transmission line 1010, also realized as a printed circuit board runner, to filter 1012 and thence via circuit board runner transmission line 1013 to RF receiver 1014. Filter 1012, which also may be one of the inventive band pass filters illustrated in FIGS. 5 and 8, has a pass band centered about the frequency of the receive signal, while at the same time greatly attenuating the transmit signal Similarly, the length of transmission line 1010 is selected to maximize its impedance at the transmit signal frequency for further attenuating the transmit signal.

Figure 11:
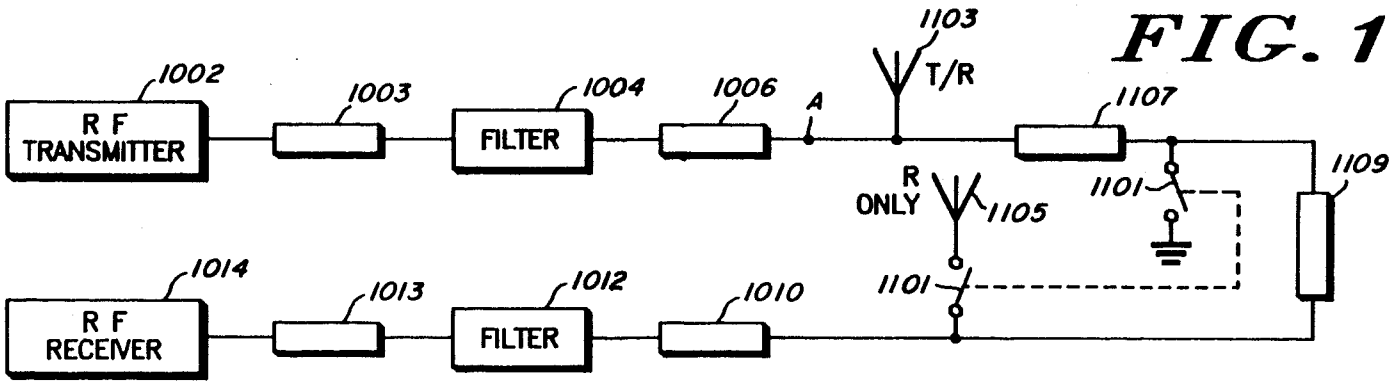
FIG. 11 is a schematic diagram of a printed circuit mounted duplexer employing component-mountable filters in a diversity receive antenna configuration.

In the embodiment of the RF signal duplexing apparatus of FIG. 10, transmit signals having a frequency range from 825 MHz to 851 MHz and receive signals having a frequency range from 870 MHz to 896 MHz are coupled to the antenna of a mobile radio. The dielectric band pass filters 1004 and 1012 utilize a dielectric of ceramic and are constructed in accordance with the present invention as shown in FIG. 5. The filters 1004 and 1012 each have a length of 3.0 inch and a width of 0.45 inch. The height is a primary determinant of the frequency of operation and, in the preferred embodiment, is 0.49 inch in the transmit filter 1004 and 0.44 inch in the receive filter 1012. Filter 1004 has an insertion loss of 2.5 dB and attenuate receive signals by at least 50 dB. Filter 1012 has an insertion loss of 3.0 dB and attenuates receive signals by at least 60 dB. An alternative interconnection of the circuit board monostable dielectric block filters is shown in FIG. 11.

It is sometimes desirable to utilize two switchable antennas for a receiver so that the antenna receiving the best signal may be switchably coupled to the receiver and provide the well-known antenna diversity function. By not providing a transmission line coupling directly between transmission lines 1006 and 1010 (at point A) but by inserting an antenna switch 1101 selecting a shared transmit/receive antenna 1103 and a receive only antenna 1105 between the antennas, the separate transmit and receive filters 1004 and 1012 may be coupled by 180° reflection coefficient transmission lines 1107 and 1109 in a fashion to provide a diversity receive function.

The filter operational characteristics may be determined by the metallization pattern employed on the surface of the dielectric block which is not fully metallized. Dielectric filters such as described herein are instrinsically coupled by inductance. That is, the magnetic fields in the dielectric material govern the coupling. The inductance may be changed, and even overcome, by introducing capacitive between the resonators. Referring again to FIG. 5, it can be seen that a seven pole configuration is realized by serially coupling the resonators created by the metallized holes 529–535 and surface plating 539–543. As shown, the capacitive coupling between the resonators is restricted by the grounded strip electrodes 554–557. Capacitive coupling by metalization gaps or additional metalization islands has been shown in the aforementioned U.S. patent application Ser. No. 656,121 by Kommrusch filed Sept. 27, 1984. According to one novel aspect of the present invention, a controlled capacitive coupling may be achieved by providing incomplete strip electrodes running on the surface of the dielectric block between two resonators. In the preferred embodiment, incomplete strip electrodes 553 and 558, between input resonator and output resonator and the other resonators, provide a controlled capacitive coupling to enable combined inductive and capacitive coupling between adjacent resonators. In practice, the use of inductive or capacitive coupling provides steeper filter attenuation skirts on either the high side of the filter passband or the low side of the filter passband, respectively.

When the dielectric filter blocks are combined as a duplexer filter as shown diagrammatically in FIG. 10, it is advantageous to employ a filter having a step attenuation skirt above the passband as the filter passing the lower frequencies. Also it is advantageous to employ a filter having a steep attenuation skirt below the passband as the filter passing the higher frequencies. In this way, additional protection of transmit and receive paths from each other can be realized without additional filter resonator elements.

Figure 12A:
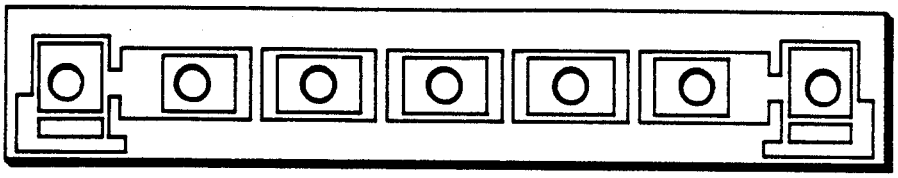
FIG. 12A, 12B, 12C, 12D, and 12E illustrate metalization patterns which may be employed in the present invention.
Figure 12B:
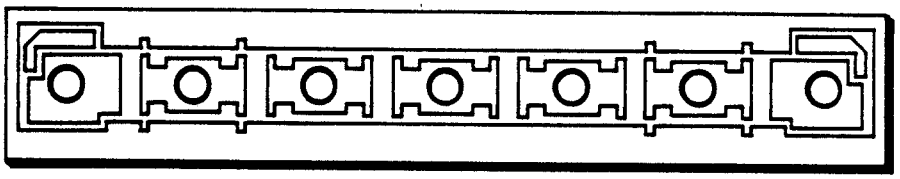
Figure 12C:
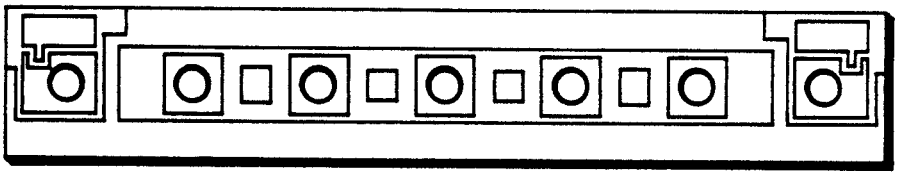

An advantage of the dielectric filter blocks of the present invention is that the number and spacing of resonators used in the transmitter filter 1004 (of FIG. 10) may be equal to the number and spacing of the resonators in the receive filter 1012. The type of coupling is determined by the metalization pattern employed. The transmit filter 1004 utilizes inductive coupling between resonators as illustrated in the metalization pattern of FIG. 12A. The capacitive coupling between the middle resonators is reduced by the complete strip electrodes while the input and output resonators utilize more capacitance in the incomplete strip electrodes in their coupling to the middle resonators. The receive filter 1012 utilizes capacitive coupling between resonators as illustrated in the metalization pattern of FIG. 12B. Capacitive coupling is enabled by the unblocked metalized resonators. (Capacitive coupling may be enhanced by metalization islands such as shown in FIG. 12C).

Figure 12D:
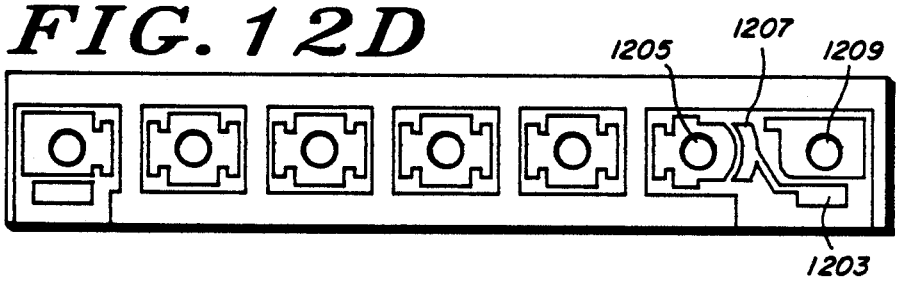

A novel feature of the present invention creates the ability of the coupling to be changed by changing the metalization Additionally, the mode of resonator operation may be changed from band pass to band stop by utilizing one or more resonators as a transmission zero rather than as a transmission pole. Transmission zero realization by metalization change only is shown in FIG. 12D. The output electrode 1203 is coupled to the first transmission pole resonator 1205 by metalization runner 1207. Coupling is also realized from output electrode 1203 to transmission zero resonator 1209. In the embodiment shown, the transmission zero is tuned to the low side of the passband to realize additional rejection on the low side of the passband. A filter utilizing metalization such as that shown in FIG. 12D would be suitable for use in a duplexer such as described above.

Figure 12E:
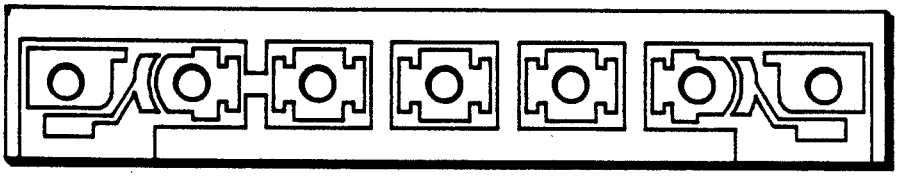

Additional zeros may be created by proper coupling to other resonators. Such coupling is shown in the metalization of FIG. 12E.

In summary, then, a multiple resonator dielectric filter has been shown and described. This filter utilizes metalized hole resonators having coupling characteristics determined by the metalization pattern on one surface of the dielectric block. The dielectric block is metalized with a conductive material on all but one surface from which the hole resonators extend into the dielectric block. Electrode metalization around the holes provides capacitive coupling to this conductive material and from one resonator to an adjacent resonator. Capacitive coupling between the resonators is controlled by an electrode at least partially between two adjacent hole resonators to adjust the capacitive coupling between the resonators. Therefore, while a particular embodiment of the invention has been described and shown, it should be understood that the invention is not limited thereto since many modifications may be made by those skilled in the art. It is therefore contemplated to cover any and all such modifications that fall within the true spirit and scope of the basic underlying principles disclose and claimed herein.

We claim:

1. A duplex radio transceiver coupled to one antenna for both receive and transmit functions, comprising:

a transmitter;

a receiver;

a duplexer filter disposed between said transmitter and the antenna, and between said receiver and the antenna, said duplexer filter further comprising:

(a) at least two volumes of dielectric material, each volume of dielectric material having first, second, and side surfaces, said second and side surfaces of each volume of dielectric material being substantially covered with a conductive material;

(b) a plurality of holes extending through each said volume of dielectric material from said first surface to said second surface, the surface of at least two of said holes through each of said volume of dielectric material being substantially covered with a conductive material which is electrically common at said second surface of each respective volume of dielectric material, thereby forming at least two resonators in each said volume of dielectric material;

(c) first means for coupling a first of said at least two resonators of a first one of said at least two volumes of dielectric material to a first input-/output terminal;

(d) second means for coupling a second of said at least two resonators of a first one of said at least two volumes of dielectric material to a second input/output terminal;

(e) third means for coupling a first of said at least two resonators of a second one of said at least two volumes of dielectric material to a third input/output terminal;

(f) fourth means for coupling a second of said at least two resonators of a second one of said at least two volumes of dielectric material to a fourth input/output terminal;

(g) mounting means comprising a conductive material for supporting at least one of said volumes of dielectric material on a substrate; and (h) a first transmission line disposed on said substrate and coupling said first input/output terminal to said third input/output terminal and to the antenna whereby receiver signals from the antenna may be rejected by said first volume of dielectric material and transmitter signals from the transmitter may be rejected by said second volume of dielectric material.

2. A duplex radio transceiver in accordance with claim 1 further comprising:

a second transmission line disposed on said substrate and coupling said second input/output terminal to the radio transceiver transmitter; and a third transmission line disposed on said substrate and coupling said fourth input/output terminal to the radio transceiver receiver.

3. A duplexer filter for a radio transceiver employing one antenna for both receiving and transmitting radio signals, comprising:

a first volume of dielectric material having at least two holes extending from a first external surface of a plurality of external surfaces of said first volume toward a second external surface of said plurality of external surfaces of said first volume, all surfaces of said first volume including surfaces within said at least two holes being substantially covered with a conductive material with the exception of said first external surface upon which surface is disposed at least one electrode coupled to said conductive material of one of said at least two hole surfaces;

a second volume of dielectric material having at least two holes extending from a first external surface of a plurality of external surfaces of said second volume toward a second external surface of said plurality of external surfaces of said second volume, all surfaces of said second volume including surfaces within said at least two holes being substantially covered with a conductive material with the exception of said first external surface upon which surface is disposed at least one electrode coupled to said conductive material of one of said at least two hole surfaces;

first mounting means comprising:

(a) a conductive material having a recessed area for accepting and holding said first volume of dielectric material and an interior surface within said recessed area disposed essentially parallel to one of said plurality of external surfaces of said first volume of dielectric material, (b) a terminal extending through said interior surface and providing electrical contact to said electrode, and (c) a plurality of mounting tabs disposed at predetermined positions opposite said recessed area for affixing said first volume of dielectric material to a substrate; and coupling means disposed on said substrate for coupling said terminal of said first volume to said second volume whereby receiver signals from the antenna may be rejected by one of said first and second volumes and transmitter signals from the radio transceiver transmitter may be rejected by another of said first and second volumes.

4. A duplexer filter for a radio transceiver employing one antenna for both receiving and transmitting radio signals, comprising:

a first volume of dielectric material having at least two holes extending from a first external surface of a plurality of external surfaces of said first volume toward a second external surface of said plurality of external surfaces of said first volume, all surfaces of said first volume including surfaces within said at least two holes being substantially covered with a conductive material with the exception of said first external surface upon which surface is disposed at least one electrode coupled to said conductive material of one of said at least two hole surfaces;

a second volume of dielectric material having at least two holes extending from a first external surface of a plurality of external surfaces of said second volume toward a second external surface of said plurality of external surfaces of said second volume, all surfaces of said second volume including surfaces within said at least two holes being substantially covered with a conductive material with the exception of said first external surface upon which surface is disposed at least one electrode coupled to said conductive material of one of said at least two hole surfaces;

first mounting means comprising:

(a) a conductive material having a recessed area for accepting and holding said second volume of dielectric material and an interior surface within said recessed area disposed essentially parallel to one of said plurality of external surfaces of said second volume of dielectric material, (b) a terminal extending through said interior surface and providing electrical contact to said electrode, and (c) a plurality of mounting tabs disposed at predetermined positions opposite said recessed area for affixing said second volume of dielectric material to a substrate; and coupling means disposed on said substrate for coupling said terminal of said second volume to said first volume whereby receiver signals from the antenna may be rejected by one of said first and second volumes and transmitter signals from the radio transceiver transmitter may be rejected by another of said first and second volumes.

5. A duplexer filter for a radio transceiver employing one antenna for both receiving and transmitting radio signals, comprising:

a first volume of dielectric material having at least two holes extending from a first external surface of a plurality of external surfaces of said first volume toward a second external surface of said plurality of external surfaces of said first volume, all surfaces of said first volume including surfaces within said at least two holes being substantially covered with a conductive material with the exception of said first external surface upon which surface are disposed first and second electrodes coupled to said first and second hole surface conductive materials, respectively, thereby forming resonators which may be tun ed to a receiver frequency;

a second volume of dielectric material having at least two holes extending from a first external surface of a plurality of external surfaces of said second volume toward a second external surface of said plurality of external surfaces of said second volume, all surfaces of said second volume including surfaces within said at least two holes being substantially covered with a conductive material with the exception of said first external surface upon which surface are disposed first and second electrodes coupled to said first and second hole surface conductive materials, respectively, thereby forming resonators which may be tuned to a transmitter frequency;

first mounting means comprising:

(a) a conductive material having a recessed area for accepting and holding said first volume of dielectric material and an interior surface within said recessed area disposed essentially parallel to one of said plurality of external surfaces of said first volume of dielectric material, (b) first and second terminal means extending through said interior surface and providing electrical contact respectively to said first and second electrodes, and (c) a plurality of mounting tabs disposed at predetermined positions opposite said recessed area for affixing said first volume of dielectric material to said substrate;

second mounting means comprising:

(a) a conductive material having a recessed area for accepting and holding said second volume of dielectric material and an interior surface within said recessed area disposed essentially parallel to one of said plurality of external surfaces of said second volume of dielectric material, (b) first and second terminal means extending through said interior surface and providing electrical contact respectively to said first and second electrodes, and (c) a plurality of mounting tabs disposed at predetermined positions opposite said recessed area for affixing said second volume of dielectric material to said substrate; and first coupling means disposed on a common substrate for coupling said first electrode of said first volume to said first electrode of said second volume whereby receiver signals from the antenna may be rejected by said second volume and transmitter signals from the transmitter may be rejected by said first volume.

6. A duplexer filter in accordance with claim 5 further comprising:

second coupling means disposed on said substrate for coupling said second terminal of said first mounting means to the radio transceiver receiver; and third coupling means disposed on said substrate for coupling said second terminal of said second mounting means to the radio transceiver transmitter.

7. A duplexer filter for a radio transceiver employing at least one antenna for both receiving and transmitting radio signals, comprising:

a first filter comprising a plurality of resonators, at least one of said plurality of resonators formed from at least one hole in a dielectric material being substantially covered with a conductive material and extending from a first external surface of said dielectric material to a second external surface, said dielectric material being substantially covered with a conductive material with the exception of said first external surface upon which surface is disposed at least one electrode coupled to said conductive material of said at least one hole;

a second filter comprising a plurality of resonators, at least one of said plurality of resonators formed from at least one hole in a dielectric material being substantially covered with a conductive material and extending from a first external surface of said dielectric material to a second external surface, said dielectric material being substantially covered with a conductive material with the exception of said first external surface upon which surface is disposed at least one electrode coupled to said conductive material of said at least one hole;

mounting means comprising:

(a) a conductive material having a recessed area for accepting and holding said first filter, an interior surface within said recessed area disposed essentially parallel to one of said two external surfaces of said dielectric material of said first filter, (b) a terminal extending through said interior surface and coupled to said at least one electrode of said first filter, and (c) a plurality of mounting tabs disposed at predetermined positions opposite said recessed area for affixing said first filter to a substrate; and coupling means disposed on said substrate for coupling said terminal of said first filter to said second filter whereby receiver signals from the at least one antenna may be rejected by one of said first and second filters and transmitter signals from the radio transceiver transmitter may be rejected by another of said first and second filters.

8. A duplexer filter for a radio transceiver employing at least one antenna for both receiving and transmitting radio signals, comprising:

a first filter comprising a plurality of resonators, at least one of said plurality of resonators formed from at least one hole in a dielectric material being substantially covered with a conductive material an d extending from a first external surface of said dielectric material to a second external surface, said dielectric material being substantially covered with a conductive material with the exception of said first external surface upon which surface is disposed at least one electrode coupled to said conductive material of said at least one hole;

a second filter comprising a plurality of resonators, at least one of said plurality of resonators formed from at least one hole in a dielectric material being substantially covered with a conductive material and extending from a first external surface of said dielectric material to a second external surface, said dielectric material being substantially covered with a conductive material with the exception of said first external surface upon which surface is disposed at least one electrode coupled to said conductive material of said at least one hole;

mounting means comprising:

(a) a conductive material having a recessed area for accepting and holding said second filter, an interior surface within said recessed area disposed essentially parallel to one of said two external surfaces of said dielectric material of said second filter, (b) a terminal extending through said interior surface and coupled to said at least one electrode of said second filter, and (c) a plurality of mounting tabs disposed at predetermined positions opposite said recessed area for affixing said second filter to a substrate; and coupling means disposed on said substrate for coupling said terminal of said second filter to said first filter whereby transmitter signals from the radio transceiver transmitter may be rejected by on e of said first and second filters and receiver signals from the at least one antenna may be rejected by another of said first and second filters.

9. A duplexer filter for a radio transceiver employing at least one antenna for both receiving and transmitting radio signals, comprising:

a first filter comprising a plurality of resonators, at least one of said plurality of resonators formed from a conductive material substantially covering the surface of at least one hole extending from a first external surface of a dielectric material to a second external surface of said dielectric material, said dielectric material being substantially covered with a conductive material with the exception of said first external surface, upon which surface is disposed at least one electrode coupled to said conductive material of said at least one hole;

a second filter comprising a plurality of resonators, at least one of said plurality of resonators formed from a conductive material substantially covering the surface of at least one hole extending from a first external surface of a dielectric material to a second external surface of said dielectric material, said dielectric material being substantially covered with a conductive material with the exception of said first external surface, upon which surface is disposed at least one electrode coupled to said conductive material of said at least one hole;

mounting means comprising:

(a) a conductive material having a recessed area for accepting and holding said first filter, an interior surface within said recessed area disposed essentially parallel to one of said two external surfaces of said dielectric material of said first filter, and (b) a terminal extending through said interior surface and coupled to said at least one electrode of said first filter; and coupling means disposed on a substrate for coupling said terminal of said first filter to said second filter whereby receiver signals from the at least one antenna may be rejected by one of said first and second filters and transmitter signals from the radio transceiver transmitter may be rejected by another of said first and second filters.

10. A duplexer filter for a radio transceiver employing at least one antenna for both receiving and transmitting radio signals, comprising:

a first filter comprising a plurality of resonators, at least one of said plurality of resonators formed from a conductive material substantially covering the surface of at least one hole extending from a first external surface of a dielectric material to a second external surface of said dielectric material, said dielectric material being substantially covered with a conductive material with the exception of said first external surface, upon which surface is disposed at least one electrode coupled to said conductive material of said at least one hole;

a second filter comprising a plurality of resonators, at least one of said plurality of resonators formed from a conductive material substantially covering the surface of at least one hole extending from a first external surface of a dielectric material to a second external surface of said dielectric material, said dielectric material being substantially covered with a conductive material with the exception of said first external surface, upon which surface is disposed at least one electrode coupled to said conductive material of said at least one hole;

mounting means comprising:

(a) a conductive material having a recessed area for accepting and holding said second filter, an interior surface within said recessed area disposed essentially parallel to one of said two external surfaces of said dielectric material of said second filter, and (b) a terminal extending through said interior surface and coupled to said at least one electrode of said second filter; and coupling means disposed on a substrate for coupling said terminal of said second filter to said first filter whereby transmitter signals from the radio transceiver transmitter may be rejected by one of said first and second filters and receiver signals from the at least one antenna may be rejected by another of said first and second filters.

* * * * *